US006460528B1

(12) United States Patent
Gallops, Jr.

(10) Patent No.: US 6,460,528 B1
(45) **Date of Patent: *Oct. 8, 2002**

(54) CROSSBOW HAVING A NO LET-OFF CAM

(75) Inventor: Henry M. Gallops, Jr., Gainesville, FL (US)

(73) Assignee: Bear Archery, L.L.C., Gainesville, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/714,046

(22) Filed: Nov. 16, 2000

Related U.S. Application Data

(63) Continuation-in-part of application No. 09/490,043, filed on Jan. 24, 2000, now Pat. No. 6,155,243.

(51) Int. Cl.[7] ..... F41B 5/12

(52) U.S. Cl. ..... 124/25; 124/25.6

(58) Field of Search ..... 124/20.1, 25, 25.6, 124/900

(56) References Cited

U.S. PATENT DOCUMENTS

| | | | | | |
|---|---|---|---|---|---|
| 4,879,987 | A | * | 11/1989 | Nishioka | 124/25 |
| 4,917,071 | A | * | 4/1990 | Bozek | 124/25 |
| 5,119,797 | A | * | 6/1992 | Anderson | 124/25 |
| 5,630,405 | A | * | 5/1997 | Nizov | 124/25 |
| 5,678,528 | A | * | 10/1997 | Hadley | 124/25 |
| 6,155,243 | A | * | 12/2000 | Gallops | 124/25 |
| 6,267,108 | B1 | * | 7/2001 | McPherson et al. | 124/25 |

* cited by examiner

*Primary Examiner*—John A. Ricci
(74) *Attorney, Agent, or Firm*—Milton Wolson

(57) ABSTRACT

A crossbow includes having no let-off cams permits storage of more energy than a conventional compound crossbow.

12 Claims, 9 Drawing Sheets

CROSSBOW HAVING A NO LET-OFF CAM

This application is a continuation-in-part of pending U.S. patent application Ser. No. 09/490,043, filed Jan. 24, 2000 now U.S. Pat. No. 6,155,243 and entitled "Crossbow Having a No Let-Off Cam".

BACKGROUND OF THE INVENTION

1. Field of the Invention

This invention relates broadly to the field of crossbows. More particular, this invention relates to the use of at least one no let-off cam at the limb tip of a crossbow for increasing the energy stored in the bow limbs and for increasing the initial force applied to the shot.

2. State of the Art

Crossbows in use at the present time include traditional crossbows having flexible limbs which do not include cams at their limb tips and conventional compound crossbows having let off cams at their limb tips. Both the traditional crossbow and the conventional compound crossbow operate in the same general manner. A stirrup on the crossbow is placed against the ground and the shooter's foot is placed within the stirrup. The shooter then draws the bowstring cable against the force of the bow limbs storing energy in the bow limbs. When the bowstring cable is fully drawn, it is held in position by a crossbow trigger mechanism. A bolt is placed on a guide in the crossbow in proximity to the cocked bowstring cable. When the shooter actuates the trigger mechanism, the bowstring cable is released and the energy stored in the bow limbs propels the bolt from the crossbow.

In traditional crossbows, the bowstring cable is directly attached to the outer ends of the bow limbs, so that the amount of force exerted on the bowstring cable, and thus the amount of energy stored in the limbs, is substantially proportional to the distance that the bowstring cable is displaced from the initial, or brace, position. In conventional compound crossbows, the bowstring cable is attached to eccentric cams located on axles journalled in the outer ends of the bow limbs. As the bowstring cable is drawn, it rotates the eccentric cams against the countervailing force of an anchor cable which is also attached to the eccentric cams. The force exerted on the bowstring cable, and the amount of energy stored in the limbs, is dependent upon the force required to rotate the eccentric cams. In conventional compound crossbows, the eccentric cams provided let-off so that the amount of force exerted on the bowstring cable at full draw was less than the force exerted on the bowstring cable at peak weight. In such prior art compound crossbows, it was assumed that let off was necessary to reduce the pressure on the trigger mechanism.

The let off in such conventional compound crossbows was generally achieved by shaping the eccentric cams so that less draw force was required to rotate the cam after the crossbow had been drawn to its peak weight. For example, the distance between the axle on which the eccentric cam was mounted and the path on which the bowstring cable travels might be reduced after peak weight or the distance between the axle on which the eccentric cam was mounted and the eccentric path on which the anchor cable travels might be reduced after peak weight. A reduction of the force exerted on the bowstring cable after let-off caused the energy stored in the bow limbs to be reduced. In addition, because there was less energy stored in the bow limbs after let off, when the crossbow was shot, the bolt traveled with less velocity and with less kinetic energy than if it had been shot at peak weight.

SUMMARY OF THE PRESENT INVENTION

This invention recognizes that in a conventional compound crossbow, the trigger mechanism maintains the bowstring in its fully drawn position and that it is therefore unnecessary to provide let off to enable the shooter to more accurately aim the bowstring. Accordingly, it is an object of this invention to provide such a crossbow having a bowstring cable connected to eccentric cams mounted on the limb tips and wherein the eccentric cams did not provide let off after the crossbow had reached peak weight.

With the provided arrangement more energy is stored in the bow limbs when the bolt is shot and therefore the bolt is shot with higher velocity. In addition, in the present invention, the greatest amount of force exerted on the bowstring cable occurs when the bolt is shot as compared to conventional compound crossbows in which the greatest amount of force on the bowstring cable occurs before the bolt is shot. It is desirable that, as here, the greatest amount of force exerted on the bowstring cable occur when the bolt is shot because that causes the bolt to travel with higher velocity and increased kinetic energy.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
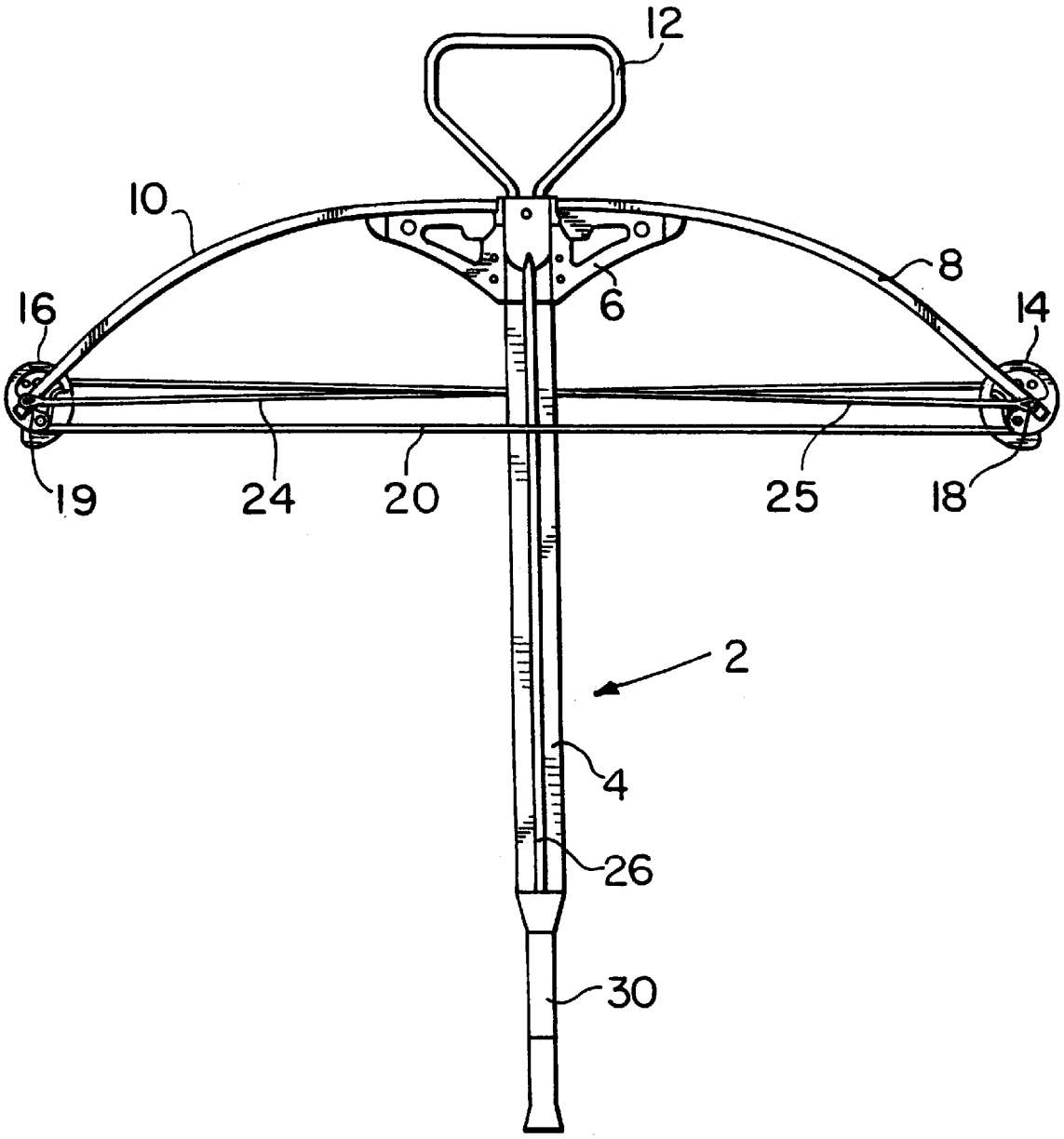
FIG. 1 is a top plan view of a crossbow in accordance with an embodiment of the present invention and wherein the crossbow has a bolt guide extending the entire length of the barrel and wherein the crossbow is in the brace position.
Figure 1A:
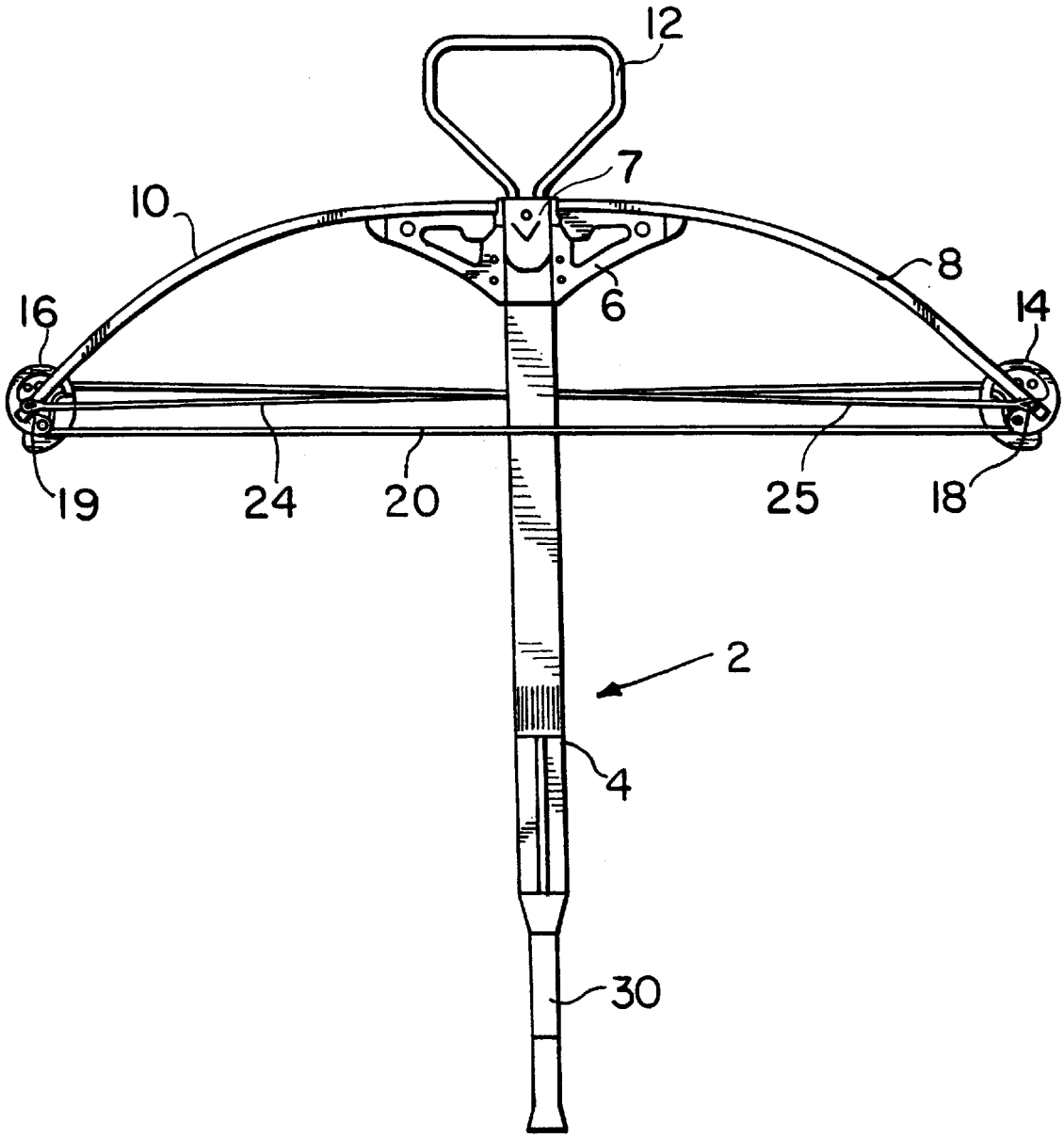
FIG. 1A is a top plan view of a crossbow in accordance with another embodiment of the present invention and wherein the crossbow has a bolt guide extending along a partial length of the barrel and wherein the crossbow is in the brace position.
Figure 2:
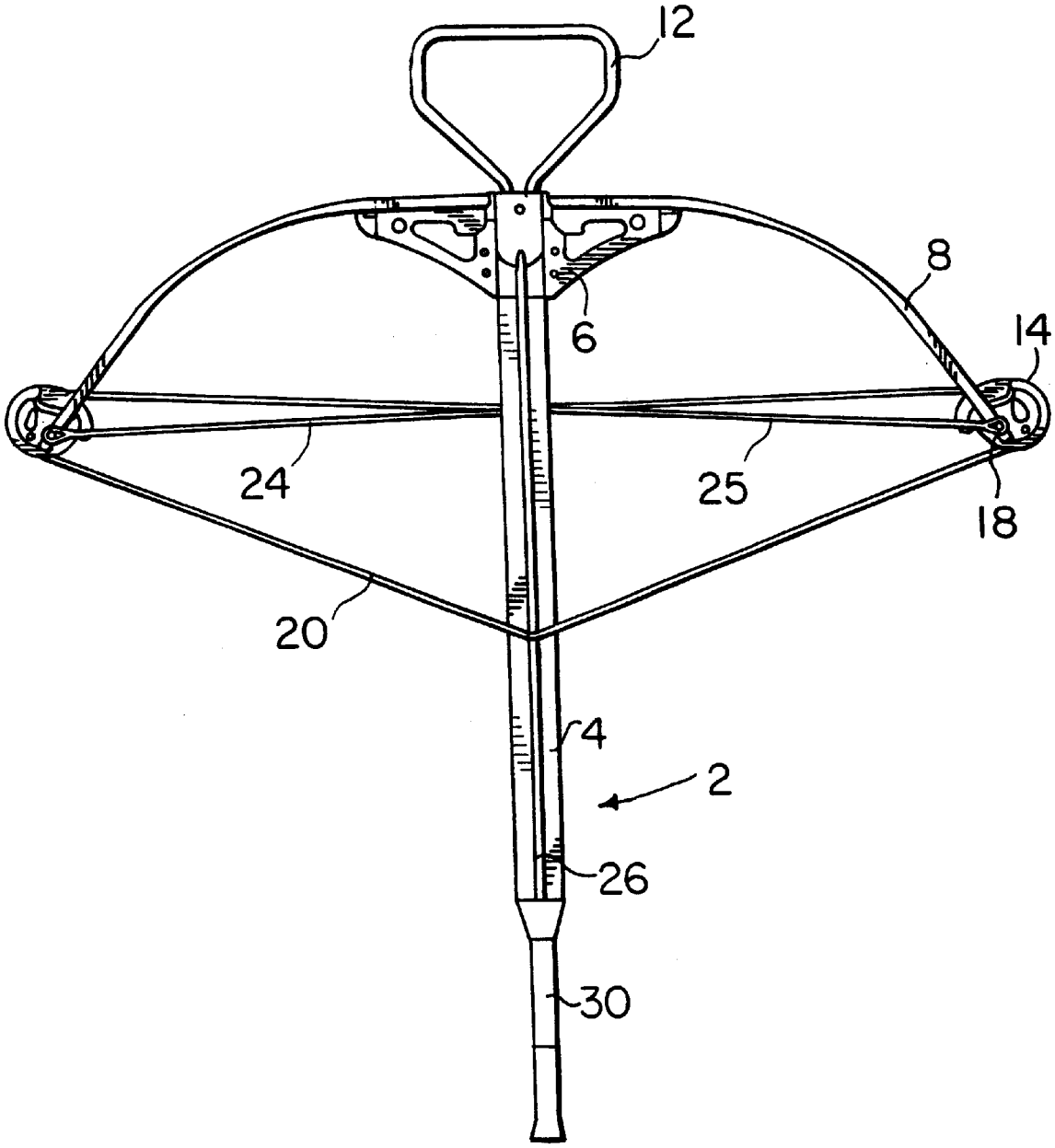
FIG. 2 is a top plan view of the crossbow shown in FIG. 1 wherein the bowstring cable is at its half-drawn position and the force on the bowstring cable is at its maximum peak weight.
Figure 3:
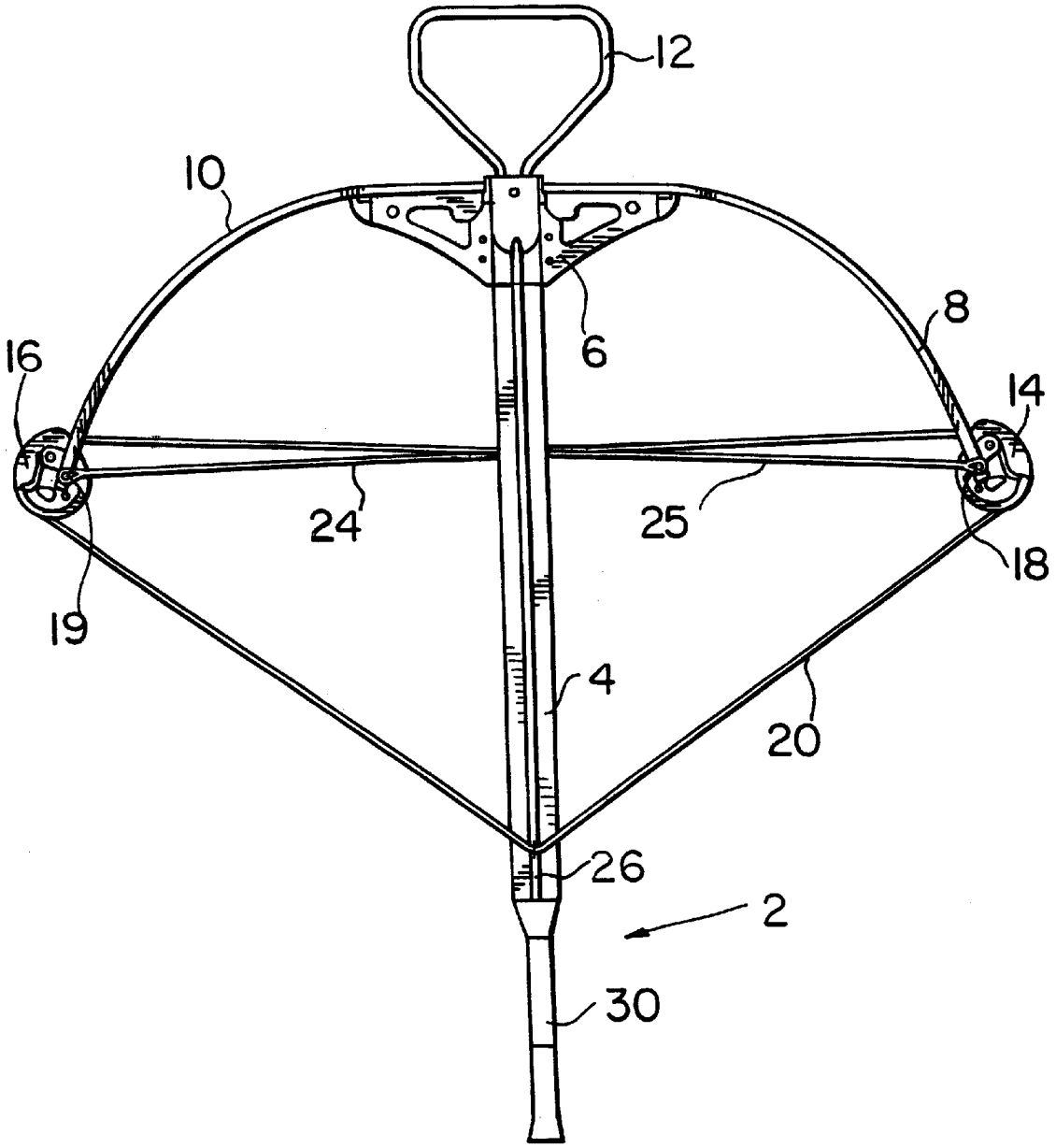
FIG. 3 is a top plan view of the crossbow shown in FIG. 1 wherein the bowstring cable is fully drawn and the force on the bowstring cable remains at its peak weight.

FIG. 1 through FIG. 3, shows a crossbow 2 which includes an elongated barrel 4 connected to a base 6. Flexible bow limbs 8 and 10 are connected to base 6 and a stirrup 12 in axial alignment with elongated barrel 4 is also connected to base 6. A bolt guide 26 extends along the entire length of barrel 4. No let-off eccentrics cams 14 and 16 are journalled on axles 18 and 19 mounted at the respective ends of bow limbs 8 and 10. A bowstring cable 20 is secured at each end to eccentric cams 14 and 16. An anchor cable 24 is fixed at one end to axle 19 and connected at the other end to-eccentric cam 14 for rotation therewith. Anchor cable 25 is fixed at one end to axle 18 and connected at the other end to eccentric cam 16 for rotation therewith. In the half-drawn position in FIG. 2, the bowstring cable is drawn 6.75 inches and in the fully drawn position in FIG. 3, the bowstring cable is drawn 13.5 inches. The crossbow 2 shown in FIG. 1A is the same as the crossbow shown in FIG. 1, except that the bolt guide 26 extends along only a partial length of barrel 4.

Figure 1B:
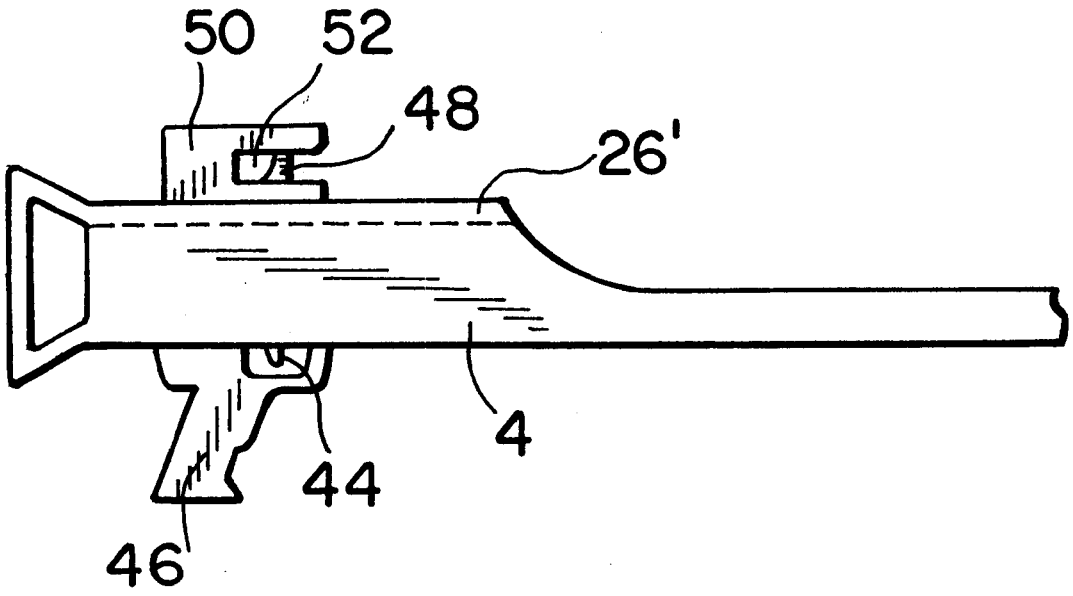
FIG. 1B is a partial side view of the crossbow shown in FIG. 1A.

Elongated barrel 4 includes a conventional trigger mechanism, shown in FIG. 1B, such as the trigger mechanism on the crossbow sold by Bear Archery, LLC under its trademark "DEVESTATOR", for capturing and releasing bowstring cable 20. A trigger 44 is located within a pistol grip portion 46. The trigger 44 is connected by suitable mechanism to a release mechanism 48 within housing 50. When the bowstring 20 is drawn, it is captured in the opening 52 between the release mechanism 48 and the housing 50. A bolt has its front end resting on arrow rest 7 on base 6. The rear end of the bolt is supported by release mechanism 48. The underside of a butt 30, located at the end of elongated barrel 4 opposite stirrup 12, rests on the shooter's shoulder to stabilize the bow when it is being shot.

Figure 4:
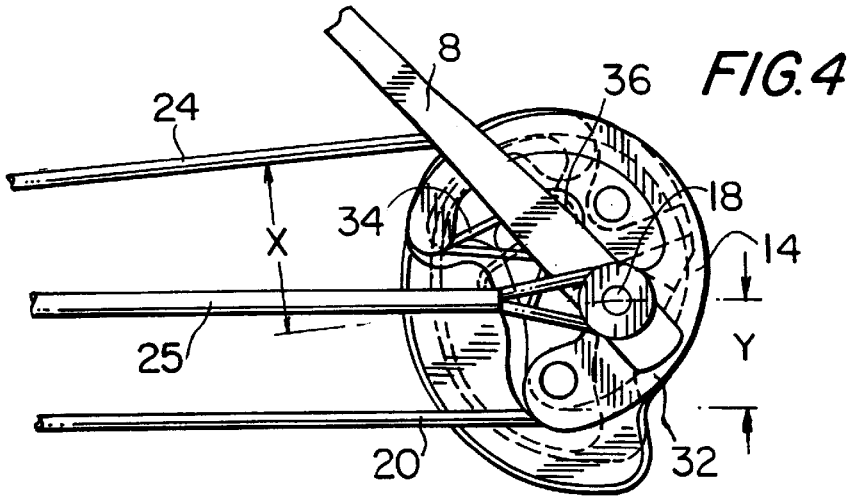
FIG. 4 is a top plan view of the right hand eccentric cam of the crossbow shown in FIG. 1.
Figure 5:
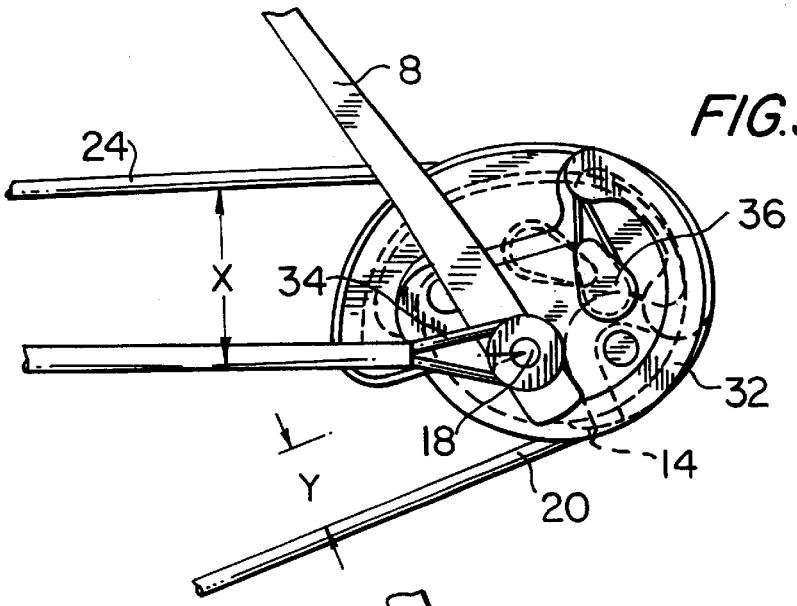
FIG. 5 is a top plan view of the cam shown in FIG. 4 when the bowstring cable is at its half-drawn position.
Figure 6:
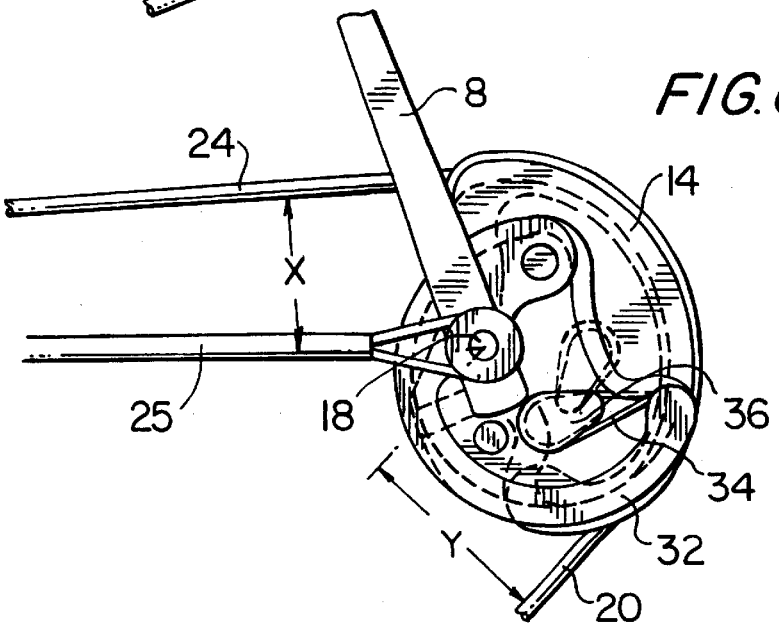
FIG. 6 is a top plan view of the cam shown in FIG. 4 when the bowstring cable is at its fully drawn position.

With reference to FIGS. 4 through 6, right-hand cam 14, which is identical to left-hand cam 16, includes a groove 32, within which bowstring cable 20 is trained. A loop 34 at the end of bowstring cable 20 is secured to anchor member 36 of cam 14. In FIG. 4, the crossbow 2 is in its brace position. In the embodiment of the present invention disclosed herein, the perpendicular distance, X, between the axle 18 and the anchor cable 24 is 1.1 inches and the perpendicular distance, Y, between the axle 18 and the bowstring cable 20 is 0.7 inches. FIG. 5 shows the bowstring cable 20 drawn to its peak weight, approximately 160 pounds, which occurs at a draw length of about 7.5 inches. In this position, eccentric cam 14 is rotated counterclock-wise (eccentric cam 16 is also rotated counterclockwise), and the distance, X, is 1.2 inches, and the distance, Y, is 0.6 inches. FIG. 6 shows the bowstring cable 20 drawn to its full draw length of about 13.5 inches. Unlike a conventional compound crossbow, when the crossbow of the present invention is drawn to its full draw length there is no let-off and the weight remains at the peak weight of 160 pounds.

Figure 7:
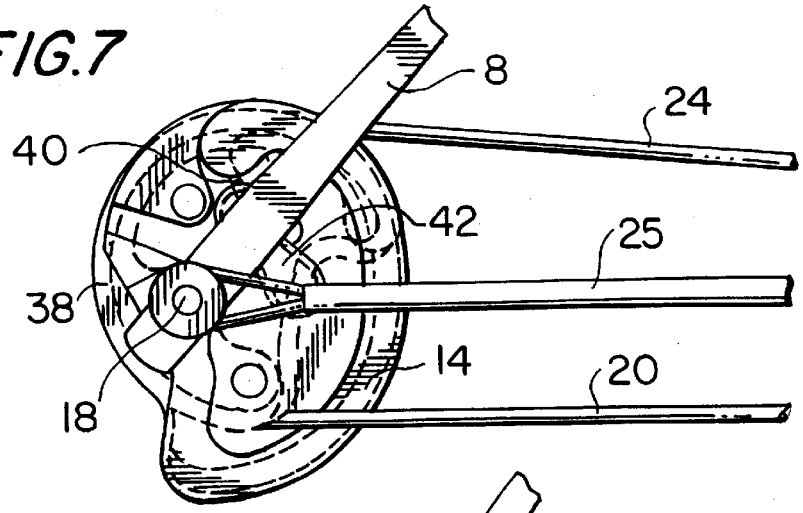
FIG. 7 is a bottom plan view of the right hand eccentric cam shown in FIG. 4.
Figure 8:
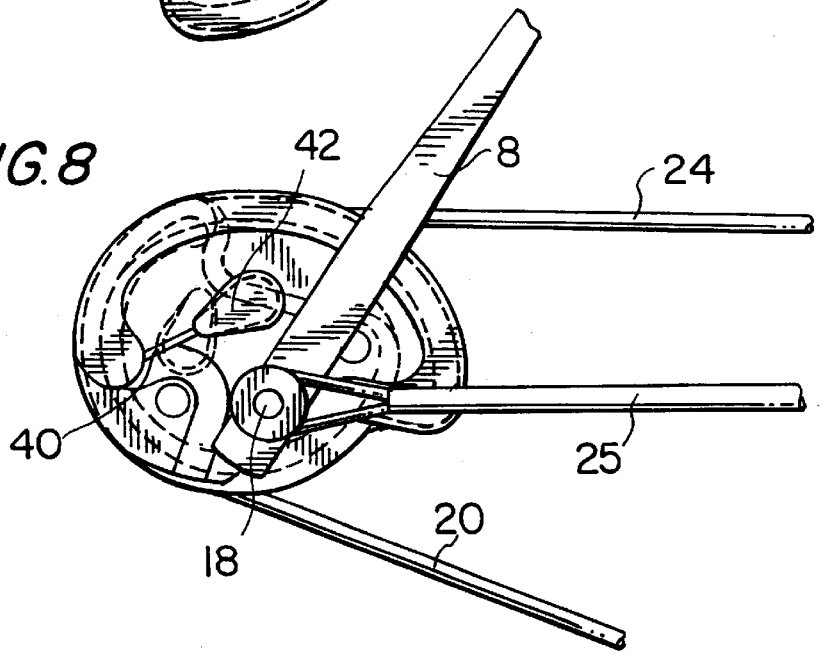
FIG. 8 is a bottom plan view of the eccentric cam shown in FIG. 4 when the bowstring cable is at its half-drawn position.
Figure 9:
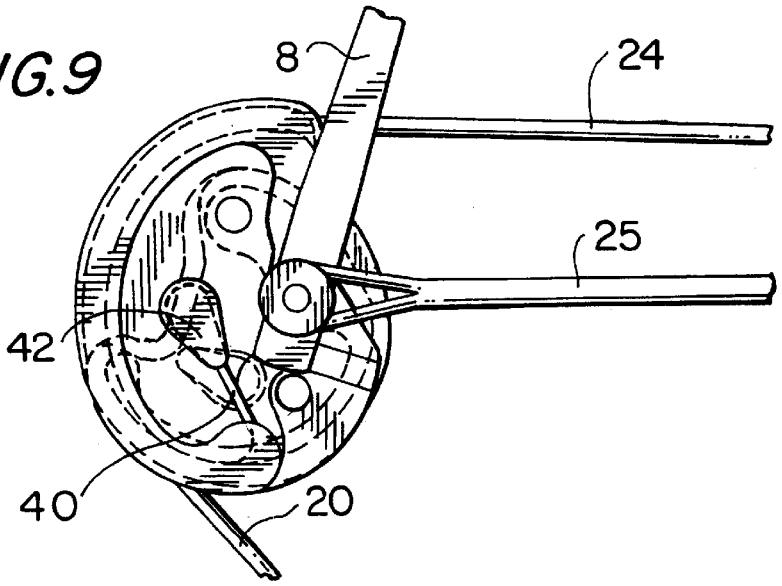
FIG. 9 is a bottom plan view of the eccentric cam shown in FIG. 4 when the bowstring cable is at its fully drawn position.

With reference to FIGS. 7 through 9, showing the underside of right-hand cam 14, when crossbow 2 is in its brace, peak weight and full drawn positions, it is seen that cam 14 includes a groove 38 within which anchor cable 24 is trained. A loop 40 at the end of anchor cable 24 is secured to anchor 42 of cam 14. In FIG. 7, the perpendicular distance between the axle 18 and the anchor cable 24 is 1.1 inches and the perpendicular distance between the axle 18 and the bowstring cable is 0.7 inches. In FIG. 8, the perpendicular distance between the axle 18 and the anchor cable 24 is 1.2 inches and the perpendicular distance between the axle 18 and the bowstring cable is 0.6 inches. In FIG. 9, the perpendicular distance between the axle 18 and the bowstring cable is 1.1 inches and the perpendicular distance between the axle 18 and the bowstring cable is 1.3 inches.

In operation the stirrup 12 of crossbow 2 is placed against the ground and the shooter's foot is placed within stirrup 12. The shooter then draws bowstring cable 20 against the force of the bow limbs 8 and 10 storing energy in bow limbs 8 and 10. When bowstring cable 20 is fully drawn, i.e., when it is at its peak weight, it is held in cocked position in opening 52 between the release mechanism 48 and the housing 50 mechanism. A bolt is placed in release 48 in proximity to the cocked bowstring. When the shooter activates the trigger 44 by pulling it rearward, the release mechanism 48 pivots clockwise so that it no longer is in position to capture bowstring 20. Thus, bowstring cable 20 is released and the energy stored in the bow limbs 8 and 10 propels the bolt from the crossbow 2.

Figure 10:
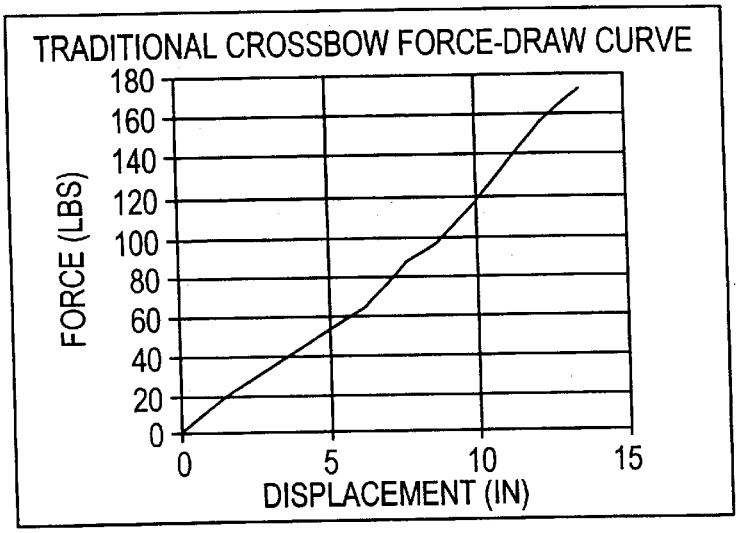
FIG. 10 is a representative force-draw curve for a traditional crossbow.
Figure 11:
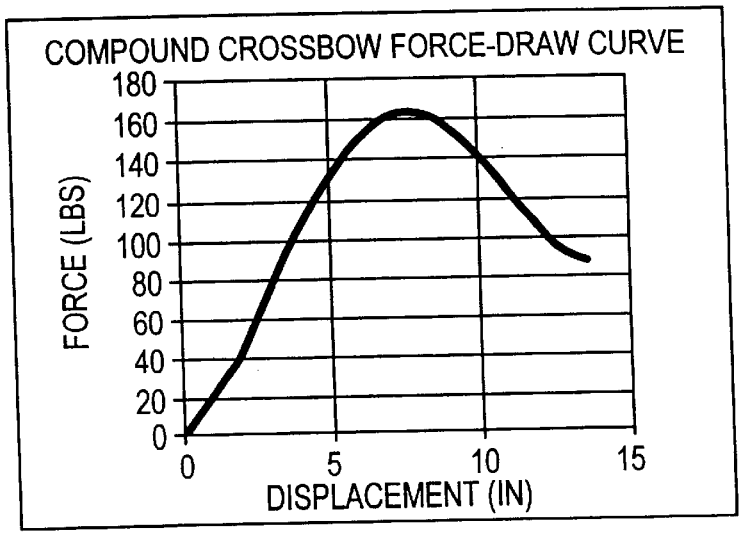
FIG. 11 is a representative force-draw curve for a conventional compound crossbow.
Figure 12:
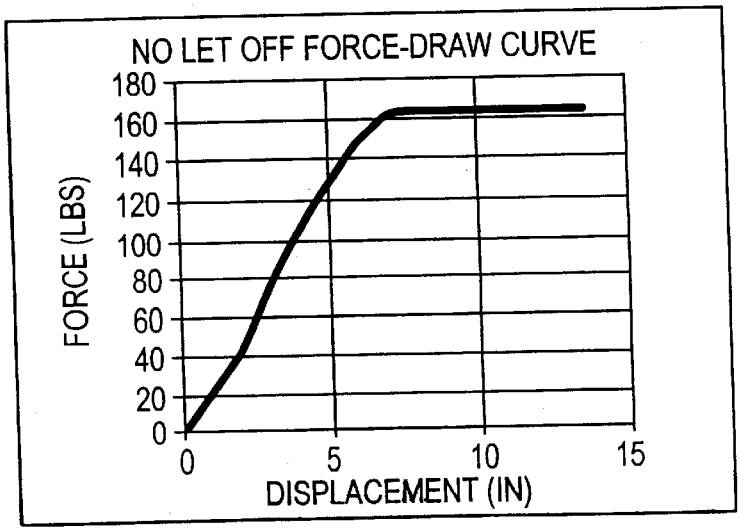
FIG. 12 is a representative force-draw curve of the no let-off compound bow of the present invention.
Figure 13:
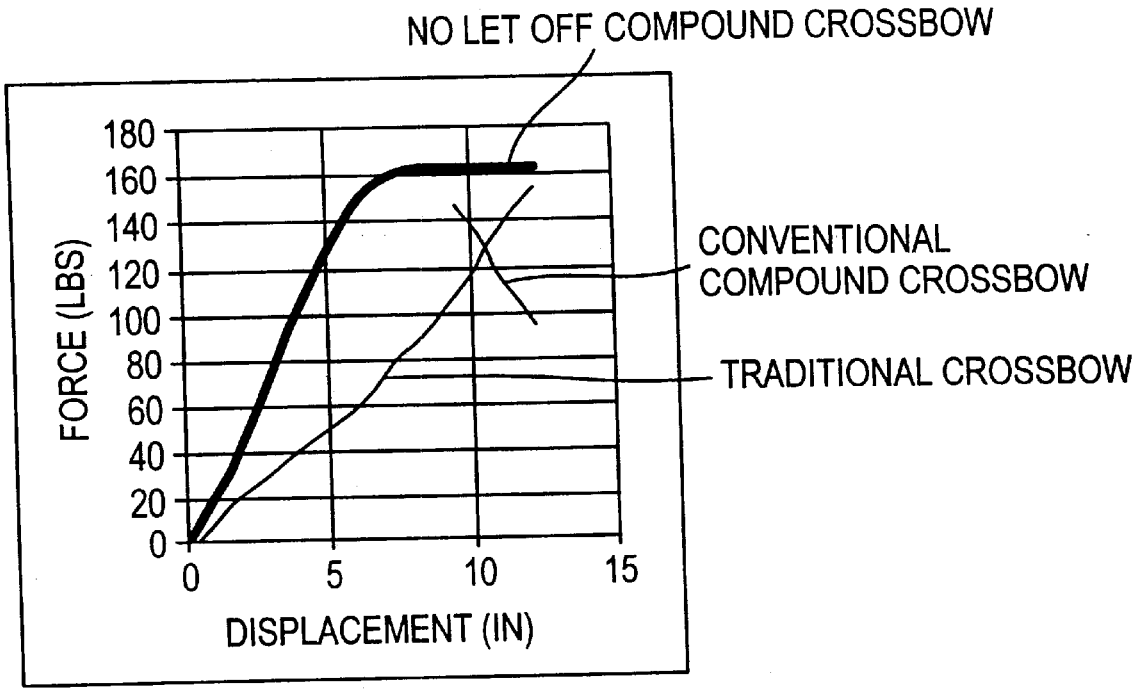
FIG. 13 is a composite of the force-draw curves shown in FIG. 10 through FIG. 12.

The present invention is further illustrated in the graphs shown in FIG. 10 through FIG. 14. In each graph, the displacement of the bowstring cable 20 from the brace position during draw is shown on the horizontal axis and the force exerted on the bowstring cable 20 during draw is shown on the vertical axis. With reference to FIG. 10, there is shown a force-draw curve for a traditional crossbow which does not include any eccentric cams. The force-draw curve for this crossbow is relatively linear. When the bowstring cable is drawn about 12.5 inches, the draw weight is approximately 160 lbs. In FIG. 11, there is shown a force-draw curve for an example of a conventional compound crossbow. The peak weight of approximately 160 pounds occurs approximately half way through the draw cycle, at approximately 6.75 inches. As the draw cycle continues to the full draw position, the force exerted on the bowstring cable is reduced, or let-off, to usually between 30 to 75% of the peak weight. The exact amount of the let-off is dependent on the shape of the eccentric cam. FIG. 12 is a force-draw curve for an example of the no-let compound crossbow of the present invention. Here, again, the peak weight of approximately 160 pounds occurs at approximately 6.75 inches of displacement from the brace position. However, unlike a conventional compound crossbow, the force exerted on the bowstring cable is not reduced. Instead the draw weight of 160 pounds is maintained for the entire draw length. At the end of the draw, the trigger mechanism engages the bowstring cable and maintains it in its full drawn position. When the shooter actuates the trigger mechanism, the bowstring cable is released and the energy stored in the limbs propels the bolt from the crossbow. Because the trigger mechanism maintains the bowstring cable in its fully drawn position, it is unnecessary to provide let-off to enable the shooter to more accurately aim the bowstring cable. FIG. 13 is a composite of the force-draw curves shown in FIGS. 10 through 12 to enable comparison of the different bows.

Figure 14:
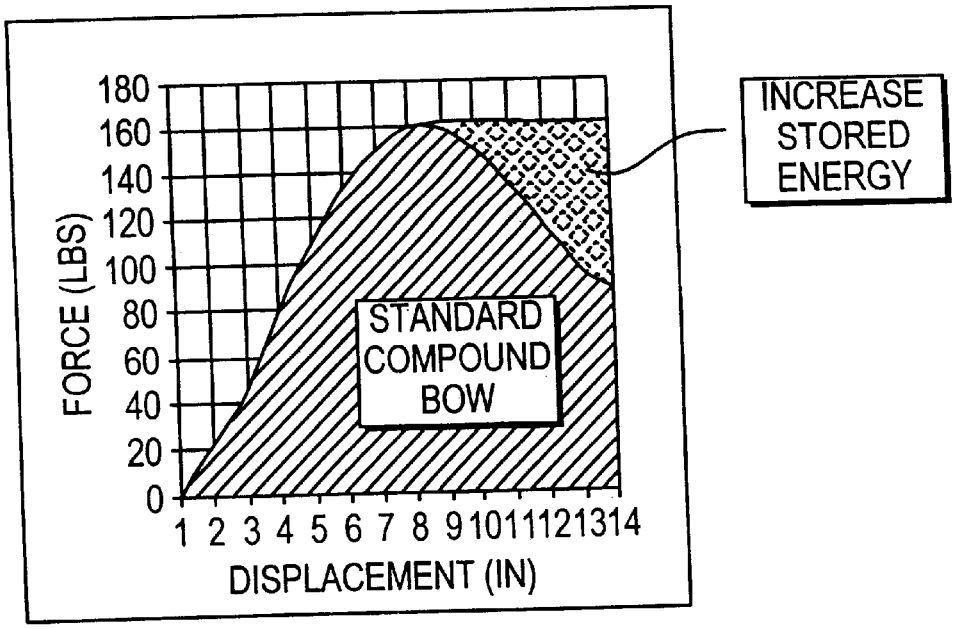
FIG. 14 is an example of a force-draw curve showing the stored energy in a traditional crossbow, conventional compound crossbow, and in the no let-off compound bow of the patent invention.

A principal benefit of the present invention is that more energy is stored in the no let-off compound crossbow than in a conventional crossbow, and therefore the bolt is shot with higher velocity. The increased amount of energy stored in the no let-off as compared to the conventional or standard compound bow is illustrated in FIG. 14. In addition, the fact that the greatest amount of force on the bowstring cable occurs when the bolt is shot causes the bolt to travel with higher velocity and increased kinetic energy, than if the bolt was shot in a conventional crossbow wherein the force on the bowstring cable when the bolt is fired would be between 30 and 70% of the peak weight.

While particular embodiments of the invention have been described, it is not intended that the invention be limited thereto, as it is intended that the invention be as broad in scope as the art will allow and that the specification be read likewise.

I claim:

1. A crossbow comprising a base;

flexible limbs attached to either side of said base;

at least one no let-off cam attached to at least one end of one of said flexible limbs;

a bowstring cable attached to said at least one no let-off cam;

at least one anchor cable attached to said at least one no let-off cam;

an elongated barrel attached to said base and having a bolt guide extending the entire length of the barrel; and a trigger actuated release mechanism for capturing and releasing the bowstring cable when it is drawn.

2. A crossbow according to claim 1, which includes two no let-off cams and two anchor cables.

3. A crossbow according to claim 1 which includes a stirrup attached to the bow.

4. A crossbow according to claim 1 which includes a butt attached to the elongated barrel.

5. A crossbow comprising a base;

flexible limbs attached to either side of said base;

at least one no let-off cam attached to at least one end of one of said flexible limbs;

a bowstring cable attached to said at least one no let-off cam;

at least one anchor cable attached to said at least one no let-off cam;

an elongated barrel attached to said base and having a bolt guide extending along a partial length of the barrel; and a trigger actuated release mechanism for capturing and releasing the bowstring cable when it is drawn.

6. A crossbow according to claim 5, which includes two no let-off cams and two anchor cables.

7. A crossbow according to claim 5 which includes a stirrup attached to the bow.

8. A crossbow according to claim 5 which includes a butt attached to the elongated barrel.

9. A crossbow comprising a base;

flexible limbs attached to either side of said base;

at least one no let-off cam attached to at least one end of one of said flexible limbs;

a bowstring cable attached to said at least one no let-off cam;

at least one anchor cable attached to said at least one no let-off cam;

an elongated barrel attached-to said base; and a release mechanism for capturing and releasing the bowstring cable when it is drawn.

10. A crossbow according to claim 9 which includes two no let-off cams and two anchor cables.

11. A crossbow according to claim 9 which includes a stirrup attached to the bow.

12. A crossbow according to claim 9 which includes a butt attached to the elongated barrel.

* * * * *